United States Patent [19]

Anderson

[11] 4,427,984

[45] Jan. 24, 1984

[54] PHASE-VARIABLE SPIRAL ANTENNA AND STEERABLE ARRAYS THEREOF

[75] Inventor: Roy E. Anderson, Scotia, N.Y.

[73] Assignee: General Electric Company, Schenectady, N.Y.

[21] Appl. No.: 288,092

[22] Filed: Jul. 29, 1981

[51] Int. Cl.[3] ..... H01Q 1/36

[52] U.S. Cl. ..... 343/764; 343/895

[58] Field of Search ..... 343/895, 764, 860, 861

[56] References Cited

U.S. PATENT DOCUMENTS

| | | | |
|---|---|---|---|
| 2,541,836 | 2/1951 | Salisbury | 333/261 |
| 2,663,869 | 12/1953 | Adcock et al. | 343/895 |
| 3,383,695 | 5/1968 | Jarek | 343/895 |

FOREIGN PATENT DOCUMENTS

| | | | |
|---|---|---|---|
| 1181273 | 6/1959 | France | 343/895 |

*Primary Examiner*—Eli Lieberman

*Attorney, Agent, or Firm*—Geoffrey H. Krauss; James C. Davis, Jr.; Marvin Snyder

[57] ABSTRACT

An antenna utilizes a conductive helix mounted in front of a conductive cup and transformer impedance-matching balun, with the helix rotatable about the antenna center line to allow adjustment of the variable phase thereof with respect to a reference phase. An array formed of a plurality of the phase-variable antennas allows the maximum gain lobe of that array to be steered through some angle, relative to an array center line essentially parallel to the parallel center lines of the plurality of array antennas, by variation of the individual antenna phases, relative to a reference phase. The plurality of antennas may have the feed points thereof combined, to provide a high-gain steerable array of relatively great mechanical strength.

28 Claims, 5 Drawing Figures

PHASE-VARIABLE SPIRAL ANTENNA AND STEERABLE ARRAYS THEREOF

BACKGROUND OF THE INVENTION

The present application relates to radio communications antennas and, more particularly, to a novel phase-variable antenna and to novel steerable arrays formed with a plurality of such antennas.

There is increasing interest in direct reception of radio-frequency signals, and particularly television signals, originating from geosynchronous satellites; such satellites are presently relaying many channels of program material to cable systems and network and public broadcasting stations. Recent reductions in the cost of low noise amplifiers and converters, for frequency-converting the microwave (C-band) signals to VHF or UHF channels receivable upon consumer television sets, opens the possibility for direct reception of satellite signals at the homes and apartment houses of the ultimate viewer. The antenna required for acceptable satellite television reception generally has an aperture of at least 10 feet, which relatively large aperture is required in order to capture a sufficient amount of signal energy to reduce "snow" and other deleterious picture artifacts, and to form a beam of sufficiently small width as to reduce the possibility of interference from adjacent satellites and terrestrial sources, such as microwave links and the like. Typically, a parabolic "dish" antenna is utilized, which must be fabricated of a RF reflective material (typically a metal or a metal-coated plastic) and requires an extremely sturdy mounting structure to maintain the large antenna precisely pointed at the satellite orbital position. In many locations, this large parabaloid and its mounting structure may meet with opposition for both aesthetic and zoning reasons. Further, unless the antenna and its mount are very sturdy, the large surface undergoes extreme wind loading and may pose a safety hazard.

It is therefore highly desirable to provide an antenna, and arrays thereof, which may be mounted flat against existing structural surfaces and which may be rendered unobtrusive, as by covering by plastic or the like material of a color and texture that matches the surface on which the array is mounted. By mounting the antenna array upon a building or other structure, the antenna is subject to no greater degree of wind damage than the structure itself. Phased arrays, comprising a two-dimensional field of antenna elements, are well known in the art. Typically, the beam heading of a prior art array must be adjusted: by either mechanically rotating the entire array; by adjusting a multiplicity of individual phase-shifters at a single frequency; or by adjusting the frequency of the entire array, for precise beam steering. It is therefore highly desirable to provide an array which may have the major lobe thereof steered by mechanical adjustment of each antenna in the array, and without requiring operational frequency variation or mechanical movement of the entire array.

BRIEF SUMMARY OF THE INVENTION

In accordance with the invention, a phase-variable antenna utilizes a helical conductor positioned along an axis of rotation thereof passing through a conductive plane and impedance-transformer, utilized for matching the helix feed point impedance to a desired antenna feed impedance. The phase of the signal at the antenna output, relative to a reference phase, is variable by rotation of the helix about the helix center line, with respect to a first rotational position. An array of such phase-variable antennas, mounted at preselected points in a two-dimensional matrix and with all antenna axes substantially parallel to one another, has a major beam lobe which is steerable in a plane running through any pair of helix axes, over a maximum steering angle, with respect to the aligned axes, determined by the phase difference between the various antennas of the array.

In one presently preferred embodiment, the impedance-matching means uses a metallic cup which may be recessed into the surface of a member upon which the plurality of antennas in an array are mounted. Manual rotation, and subsequent locking into position, of each of the antennas may be utilized to achieve maximum array gain for a substantially stationary source, such as a geostationary satellite.

In another embodiment of the invention, means are attached to each of the array antennas for rotating the antennas by interrelated, but not necessarily equal, amounts about their individual axes, whereby the major lobe of the entire array may be steered to any direction in an angular planar sector or a solid angular cone, responsive to a single array directional input.

Accordingly, it is one object of the present invention to provide a novel antenna having variable phase capability.

It is another object of the present invention to provide an array of antennas having the array beam heading steerable by variation of individual antenna phase.

These and other objects of the present invention will become apparent upon consideration of the following detailed description, when read in conjunction with the drawings.

DETAILED DESCRIPTION OF THE INVENTION

Figure 1:
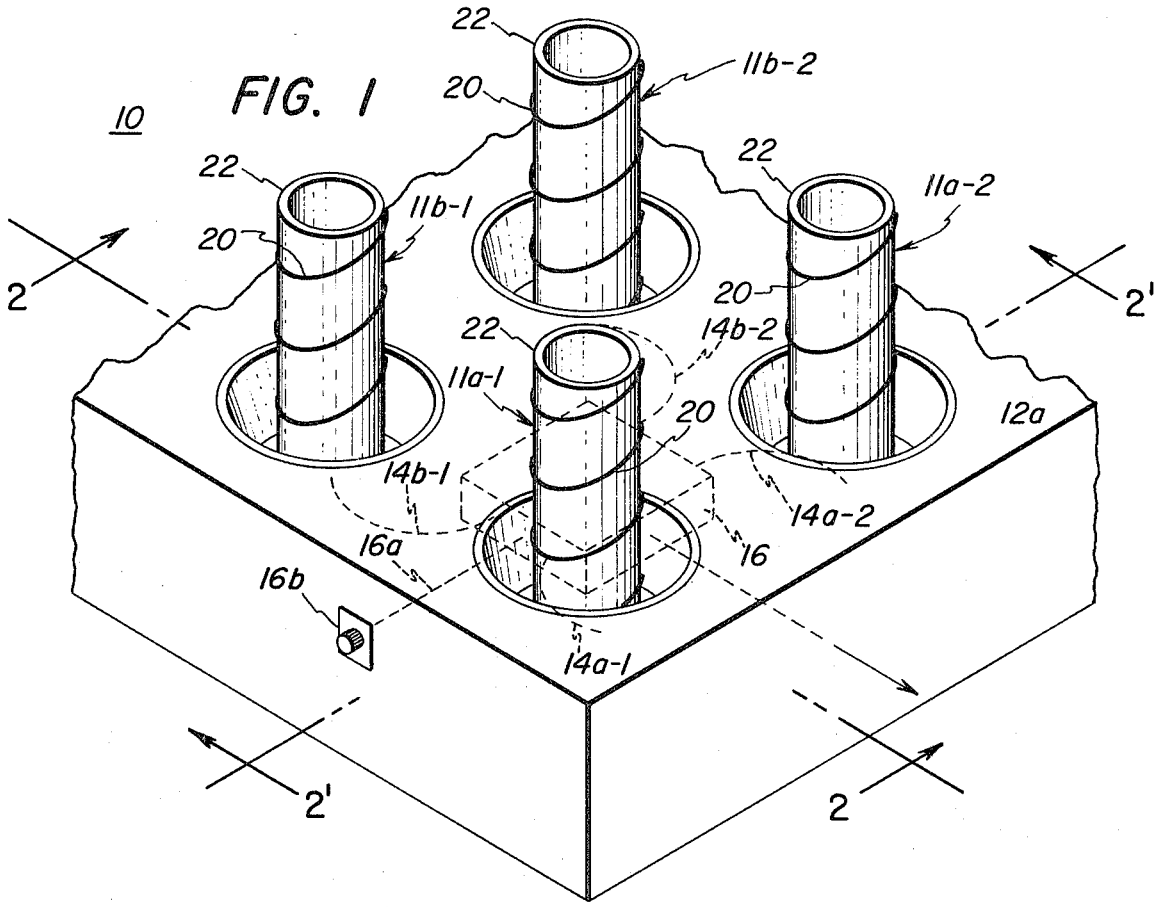
FIG. 1 is a perspective view of a portion of a steerable array utilizing the phase-variable antenna of the present invention.
Figure 2:
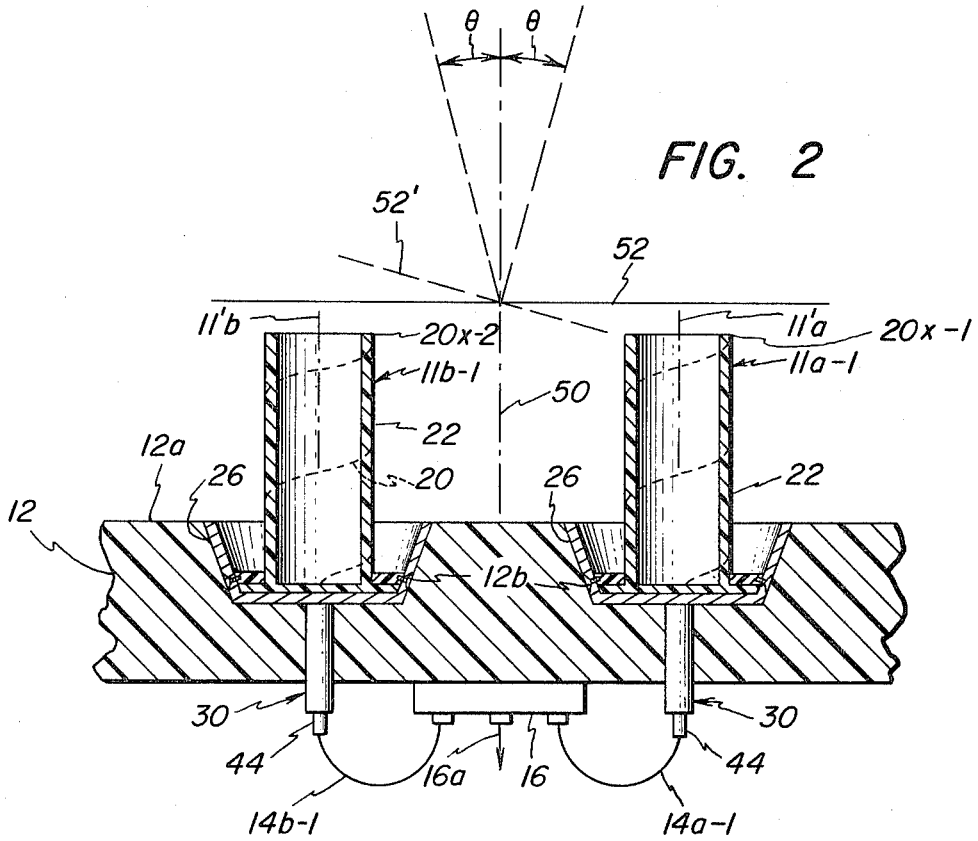
FIG. 2 is a sectional side view of the array of FIG. 1.
Figure 3:
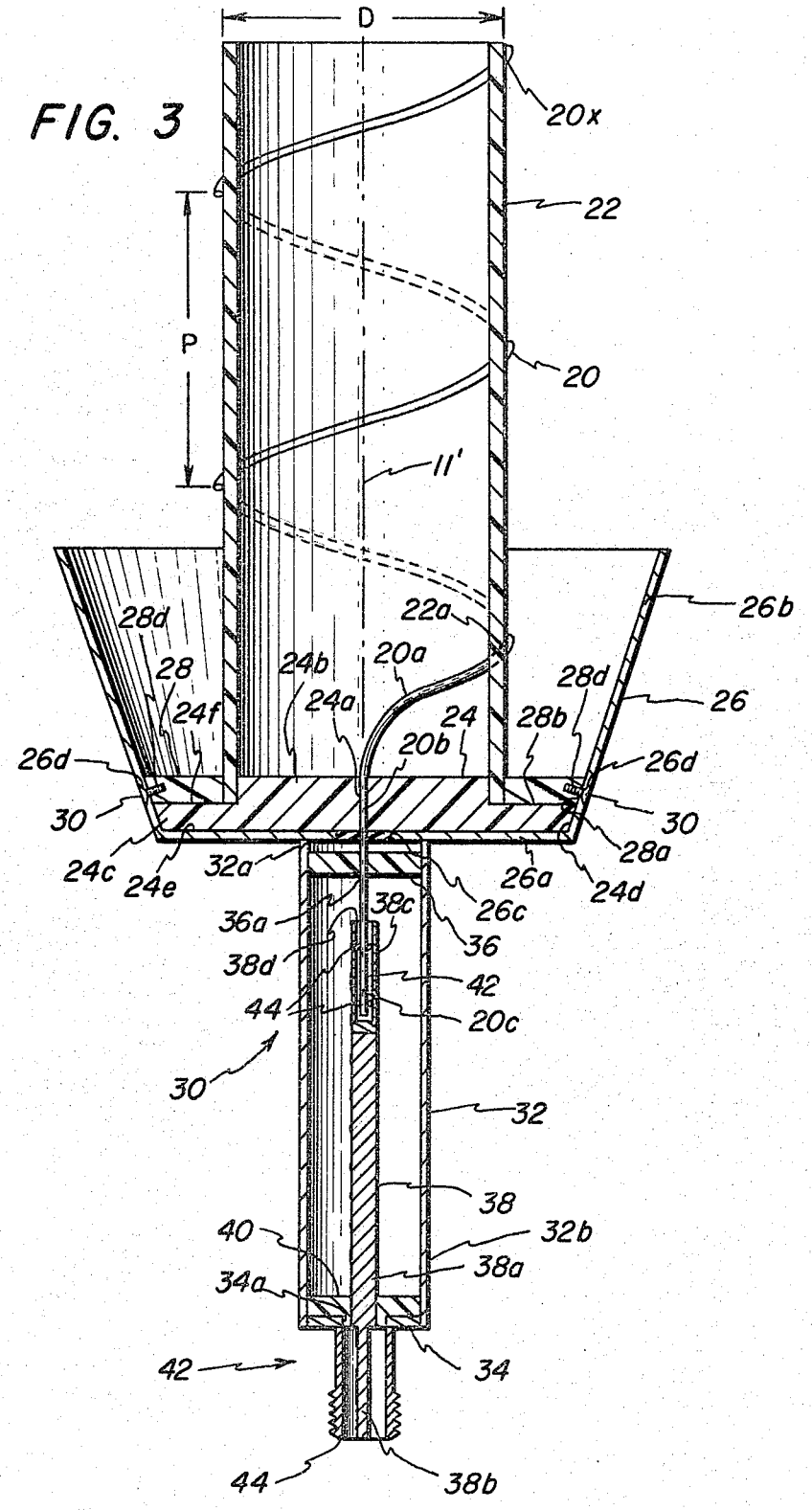
FIG. 3 is a sectionalized side view of a phase-variable antenna in accordance with the present invention.

Referring initially to FIGS. 1, 2 and 3, an antenna array 10 utilizes a plurality of phase-variable antennas 11. The array may typically have each of antennas 11 disposed at one point of a square or rectangular matrix. In the illustrated embodiment, four antennas are shown in a square array portion. A first pair of antennas 11*a*-1 and 11*a*-2 forms part of a first array column and a second pair of antennas 11*b*-1 and 11*b*-2 forms part of a second array column, disposed along a line substantially parallel to the line along which the first column of antennas 11*a* are disposed. The individual antennas 11 may be mounted upon, or preferably into, a surface 12*a* of a base member 12. Suitable leads 14, such as coaxial cable and the like, and suitable antenna output combining means, such as a four-input, one-output combiner 16 and the like, can be mounted within, or under, base member 12, for combining output of the various antennas 11 and providing the combined output via a cable 16*a* to an array output connector 16*b*, for subsequent connection to a receiver, a transmitter, a transceiver and the like equipment.

Each individual antenna 11, as best seen in FIG. 3, is a helical antenna having at least one helical turn of a conductor 20, advantageously disposed about the exterior periphery of a tube 22 of insulative material. The outer diameter D of the tube, the pitch P of the helical antenna element, the diameter of conductor 20, the number of turns and therefore the length of tube 22, and the like parameters may all be selected for a particular frequency range of operation, gain and the like electrical characteristics, and determined by formulae well known to those skilled in the art. It should be understood that the exterior periphery of tube 22 may have a helical groove formed therein in which conductor 20 is placed to assist in the winding and maintaining of the helical shape of the element. The conductor end 20*a* closest to the feed point is brought through an aperture 22*a* in the support tube wall and thence through an aperture 24*a* centrally located in a base support disk 24.

Base support member 24 is fabricated of an insulative material and is of a circular shape, having a diameter greater than the outer diameter D of support tube 22. Aperture 24*a* is placed at the center of the circular support member 24. A circular portion 24*b* of the base support member, of diameter substantially equal to the inner diameter of support tube 22, is formed about aperture 24*a*, for extension into the interior of tube 22. The remaining portion 24*c* of the support member, extending beyond the exterior surface of tube 22, allows the tube 22 and support member 24, when permanently fastened together, to be symmetrically rotated about an antenna center line 11′ passing through support member aperture 24*a* and that portion 20*b* of the antenna conductive element passing therethrough.

A conductive ground plane cup 26 has a base portion 26*a* of diameter substantially equal to the diameter of the largest radially-dimensioned portion 24*c* of base support member 24. An optional, but desirable (for reduction of side lobes and inter-antenna reactions) wall portion 26*b* of cup member 26 extends from base portion 26*a*, with substantially linearly increasing diameter in the direction of support tube 22 elongation, i.e. towards the front of antenna 11. The peripheral edge portion 24*d* of insulative base support member 24 is tapered substantially at the same angle as formed between the base portion 26*a* and the wall portion 26*b* of the cup member, whereby the insulative support member bottom surface 24*e* may be substantially in abutment with, and supported upon, the interior surface of cup base portion 26*a*. Cup base portion 26*a* includes a central aperture 26*c* for allowing passage of conductor portion 20*b* therethrough, along antenna axis 11′.

A discoidal member 28 is formed of insulative material, with an inner diameter slightly larger than the support tube 22 outer diameter D. Member 28 has an outer diameter and peripheral angle such that the member outer periphery 28*a* substantially abuts the interior surface of cup wall portion 26*b* when the member smaller-diameter surface 28*b* is substantially in abutment with the discoidal forward surface 24*f* of support member lower portion 24*c*. A plurality of apertures 26*d* are formed through the cup member wall portion 26*b*, in alignment with tapped apertures 28*d* in the periphery of discoidal member 28, whereby a plurality of fastening means 30, such as screws and the like, can be introduced through each aperture 26*d* and into an associated aligned tapped aperture 28*d*, to fixedly secure discoidal member 28 to cup 26. In this manner, conductive cup 26 and insulative member 28 prevent axial movement of the joined support tube 22-support member 24 combination, while allowing that combination (and the conductive helix 20 carried thereon) to rotate about antenna center line 11′. Rotation is further facilitated by providing clearances, on the order of milli-inches: between support member bottom surface 24*e* and the interior surface of cup base portion 26*a*; between support member radial end surfaces 24*d* and the facing interior surface of cup wall portion 26*b*; and between the lower discoidal member surface 28*b* and the associated support member discoidal portion 24*f*. Advantageously, silicone, or other non-conductive lubricating grease is introduced into these small volumes to reduce rotational friction.

An impedance-matching balun structure, for matching the feedpoint impedance of the helical antenna to the impedance of a standard RF cable, utilizes the conductive ground plane of cup member 26 and an impedance transformer means 30. The impedance transformer includes a conductive tube 32, joined at its upper end 32*a* to the exterior surface of cup member base portion 26*a*. A circular conductive member 34, having a central aperture 34*a* therein, encloses the remaining end 32*b* of the impedance transformer tube 32. A first insulative washer 36 is positioned within the bore of tube 32, adjacent to the upper end 32*a* thereof, and has an aperture 36*a* centrally located therein, to support a portion of conductor 20 axially along at least a portion of the bore of tube 32. An impedance transformer center conductor 38 has a first end 38*a* which passes through aperture 34*a* and is maintained within that aperture by an insulative shoulder washer 40. A portion 38*b* of center conductor 38 extends outwardly of the lower tube end 32*b* and forms a center pin for an RF connector means 42. A conductive connector shell 44 is placed concentrically about, but insulated from, center pin portion 38*b*, and is conductively joined to one or both of lower impedance transformer tube end 32*b* and/or conductive disk 34. The outer connector portion 44 may be threaded externally (as shown) or internally, or may have such various other attachment means as desired to mate with any of the standard RF connector series known to the art. Similarly, the diameter of pin portion 38*b* may be less than, the same as, or greater than the diameter of that portion of impedance transformer center conductor 38 within the impedance transformer tube, as required for providing an RF connector having an impedance designed to match a selected cable impedance. The ratio of the outer diameter of inner connector 38 to the inner diameter of tube 32 is selected to provide a matching transformer of desired impedance, having a length, substantially from the tube bottom end 32*b* to the inner conductor upper end 38*c*, substantially equal to an odd multiple of a quarter wavelength at a center frequency of the operational frequency range of the antenna.

A rotational bearing is provided at inner conductor upper end 38*c*, by forming an axial hole 38*d* therein, of diameter greater than the diameter of the antenna conductor wire end 20*c*. A quantity of a conductive liquid 42 is deposited within hole 38*d* and surrounds conductor end 20*c*. At least one sealing means 44 is provided to seal the conductive liquid 42 within hole 38*d* and in continuous contact between the outer surface of conductor end 20*c* and the interior surface of center conductor hole 38*d*. Advantageously, the liquid conductor is mercury. Because mercury will tend to form an amalgam with copper (normally utilized for conductor end 20*c* and impedance transformer center conductor 38) the upper end 38*c* of the impedance transformer center conductor is formed of molybdenum and the lower conductor end 20*c* is at least plated with the same material. Alternatively, the axially-extended antenna conductor portions 20*b* and 20*c*, extending through support member 24, washer 36 and into hole 38*d*, may be formed of a solid molybdenum rod, whereby a copper antenna conductor 20 may be joined thereto at, or adjacent to, support member upper surface 24*b*. Thus, it will be seen that a high-conductivity rotary joint is formed between stationary center conductor end 38*c* and the axially-disposed rotatable antenna conductor end 20*c*. The mercury-wetted metal contacts form a relatively noise-free connection.

In operation, the phase of an individual antenna is established, relative to an arbitrary reference, by rotating helix support tube 22 and attached support member 24 about the antenna axis 11', in either the clockwise or counterclockwise direction. This rotational action rotates the entire helical conductor, and thus changes the phase of the helix relative to a stationary reference, such as the remaining portions of the antenna.

Referring now particularly to FIG. 2, when a plurality of the phase-variable antennas 11 are utilized, the lengths of cables, e.g. interconnecting cables 14*a*-1 and 14*b*-1, and the phase relationship of combiner means 16, may be selected such that the signals propagated from, or received by, the illustrated pair of antennas 11*a*-1 and 11*b*-1 add vectorially. Support member 12 has recesses 12*b* therein formed to receive and securely hold the cup member 26 and tubular impedance transformer 30 of each antenna, and so positioned such that the antenna axes 11*a'* and 11*b'* are substantially parallel to one another. When the helical conductor ends 20*x*-1 and 20*x*-2 are both aligned with the same phase, i.e. at the same angular orientation with respect to the plane passing through the rotational axes of the antennas, the two-antenna array beam has a maximum gain for a distant source positioned along a line 50 lying in that plane and parallel to the parallel antenna axes. Maximum gain, from a source positioned along line 50, will be seen to occur due to the substantially lineal source wave front 52 arriving simultaneously at each conductive helix end 20*x*-1 and 20*x*-2, and propagating along the substantially identically positioned helices of the two antennas, whereby the contribution of each antenna arrives at combining means 16 with identical phase. If one antenna helix end is rotated to a different angle, with respect to the plane joining the antenna central axes 11', it will be seen that a wave from a source positioned on array axis 50 does not propagate down all of the helical conductors of the array with the same phase, whereby the plurality of signals arriving at combiner means 16 are no longer exactly in phase and the array gain is reduced. However, a source positioned at an angle to the array axis 50, but lying in the plane extending through the antenna axis 11', will provide a substantially planar wavefront, e.g. wavefront 52', which will add in phase at combiner means 16. Dependent upon the physical parameters of the antenna helix (including length, operating frequency, number of turns and like factors), the maximum magnitude of the angle $2\theta$ over which the peak beam response of the array can be steered, will be established. The maximum beam-steering angle, which forms a planar sector about the array center line 50, will also depend upon the number of antennas positioned in the steering angle plane. It will be seen that placing additional antennas to the left and right of antennas 11*a*-1 and 11*b*-1 will effect only the beam angle in the plane mutually passing through all of the antenna axes in that line. By forming a square array (as shown in FIG. 1), the phase difference between antennas along a first line, e.g. the line formed by antennas 11*a*-1 and 11*b*-1, can also be varied from the phase of the antennas in a parallel line, e.g. the line formed by antennas 11*a*-1 and 11*b*-2, whereby the beam may be steered in a second plane substantially perpendicular to the plane in which the beam may be steered if only a single line of antennas is utilized. By suitably varying the phase of each individual antenna in an array, the beam may be steered through a solid cone of maximum gain orientations. This is particularly advantageous for reception of signals from a synchronous satellite; as the satellite is essentially at the same position in the sky at all times, from any particular location, the relatively flat antenna array 10 can be mounted against a portion (such as the roof, a vertical wall and the like) of a building, upon the ground, or on any convenient support and have the perpendicular axis 50 thereof pointed in the general direction of the satellite orbital position. The phase of each antenna of the array is individually set, by rotation of the individual antenna, to steer the beam within the array steering cone and directly at the satellite. Thus, for a television receive-only (TVRO) station receiving in C-band (3.7–4.2 GHz.) the antenna helical element is on the order of four inches in length, whereby the entire array may be housed in a structure, including mounting member 12 and a cover (not shown), which may be less than six inches thick. This is not only more aesthetically pleasing than the hitherto required parabolic "dish" antenna, but also provides an antenna which has greater resistance to wind damage and can be constructed for extended dimensions and higher gain, thereby allowing the noise temperature of the subsequent low-noise amplifier, into which the antenna array output signal will be fed, to be somewhat higher. Typically, suitable gain for a TVRO antenna may be achieved with a square array having a side dimension of about twelve feet, which is compatible with the roof dimensions of the average residence.

Figure 4:
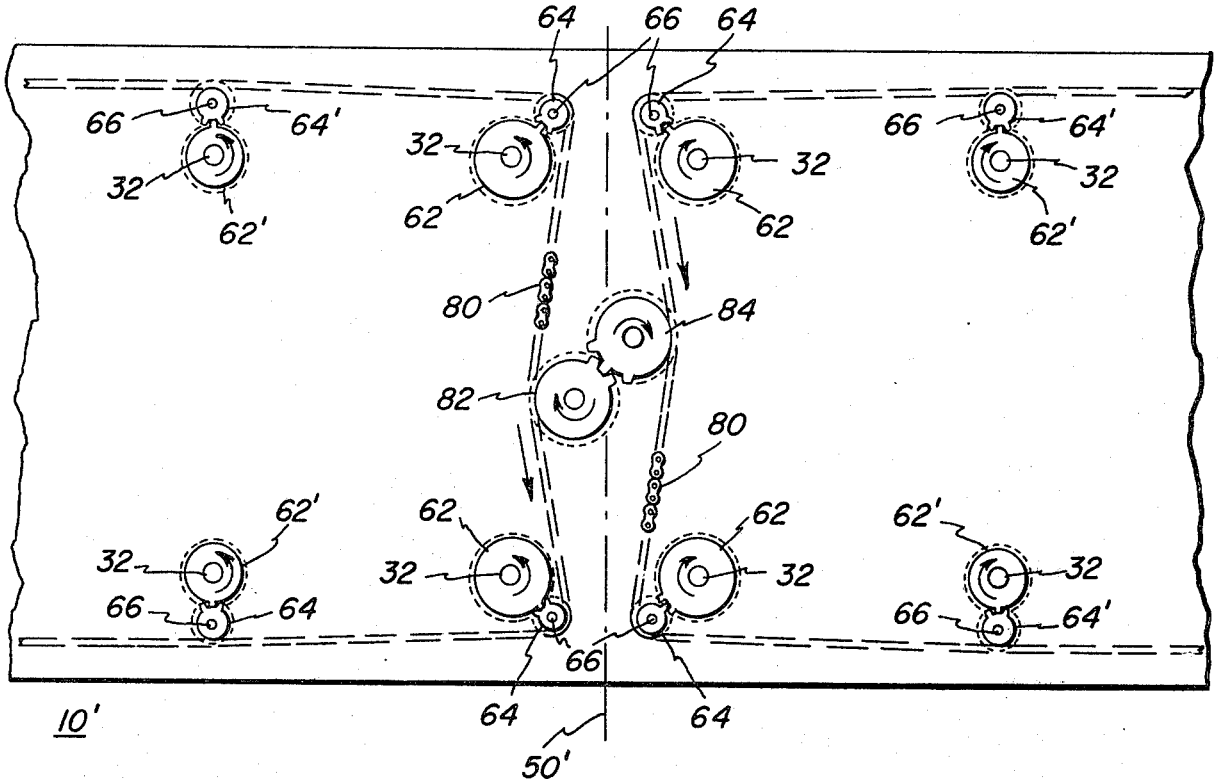
FIG. 4 is a partial plan view of one presently preferred mechanism for interactively adjusting the phase of all antennas in an array, to phase-steer the beam heading thereof.
Figure 5:
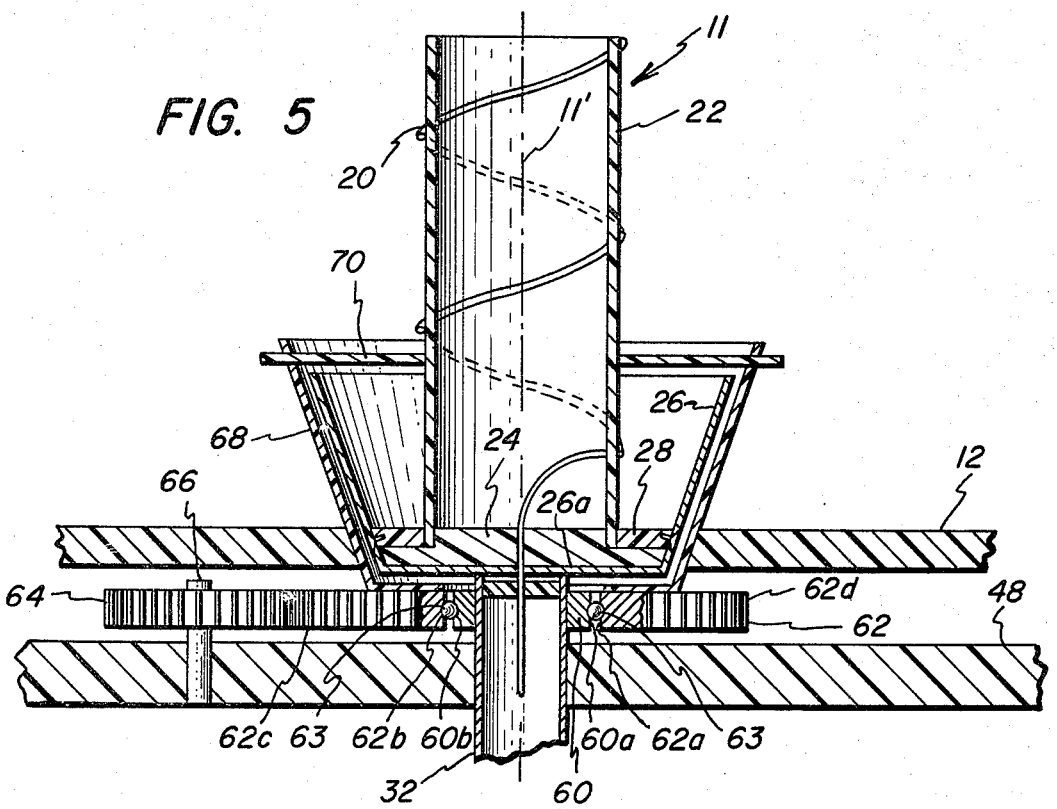
FIG. 5 is a side view of the embodiment of one antenna phase-variation mechanism which may be used in the array of FIG. 4.

For geostationary satellite and other substantially fixed bearing communication use, the rotatable portion of each antenna may be fixed in place after alignment of the array beam. For some applications, however, a beam steerable over some arc, less than or equal to the maximum phase-steering angle $2\theta$, may be required. The array 10' of FIG. 4 provides a horizontally-scanned beam, in the illustrative orientation. Each antenna 11 (FIG. 5) is provided with a ring 60 fastened to the exterior surface of tube 32, between the cup member base portion 26*a* and a mounting member 48. Disc 60 has a groove 60*a* formed into the end surface 60*b* thereof. An annular member 62 is disposed in coplanar relationship with member 60, and has a groove 62*a* formed into the interior end surface 62*b* thereof. Grooves 60*a* and 62*a* are so arranged and spaced as to contain a multiplicity of essentially spherical bearings 63, whereby annular member 62 is rotatable about antenna axis 11'. Advantageously, the outer periphery 62*c* of disc member 62 is formed with a first plurality of gear teeth. A gear member 64 is so positioned as to have the associated gear teeth thereof mesh with the gear teeth of member 62. Gear member 64 is supported for rotation upon a shaft 66 fixedly attached to mounting member 48. An insulative cup member 68 is attached to the upper surface 62*d* of gear member 62 and extends beyond conductive cup 26. A drive member 70 is formed of insulative material and fastened to the open end of cup member 68 and to the antenna support tube 20, whereby rotary motion is imparted to tube 22 by rotation of drive member 70, responsive to the rotation of cup 68 and gear member 62, as gear member 64 is rotated about shaft 66.

Illustratively, the rectangular array of FIG. 4 (of which the fixed impedance transformer 32 and drive gear 62 or 62' of only eight antennas are shown, may be extended leftwardly and rightwardly to form a 2×N array. It should be understood that the array may also be extended upwardly and downwardly, in the plane of the drawing, to provide a N×N square array or a N×M rectangular array, or such other array configuration as desired. In order to steer the array in the horizontal plane, increasing amounts of rotation are required for antennas increasingly removed from the center line 50' of the array. Accordingly, the ratio of the drive gear 64 to the antenna gear 62 increases for antenna positions increasingly removed from the center. Thus, those antennas, e.g. antennas 11*a*-1, 11*a*-2, 11*b*-1 and 11*b*-2, nearest the center line (and all substantially equidistant therefrom in the steering plane) have relatively low gear ratios, e.g. driven gear 62 has many more teeth than driving gear 64. The next group of antennas, e.g. antennas 11*a*-3, 11*a*-4, 11*b*-3 and 11*b*-4 (which are all substantially equidistant from center line 50' in the steering plane) has a somewhat higher ratio of driving gears 62' and driven gears 64', and so forth. The individual group ratios will be established by the desired array beam-steering characteristics. Means, such as drive chains 80, main gear 82 and idler gear 84 are provided to rotate each driving gear 62, 62' and the like at the same time and in the same direction, to uniformly shift the array beam heading responsive to rotation of main gear 82.

While several presently preferred embodiments of my novel phase-variable antenna and steerable arrays thereof are set forth in detail herein, many modifications and variations will now occur to those skilled in the art. It is my intent, therefore, to be limited by the scope of the appended claims and not by the specific details provided by way of explanation herein.

What is claimed is:

1. An antenna comprising:

a conductive helix having a feed end, said helix being rotatable around an axis thereof and having said feed end positioned essentially upon said axis;

an insulative support tube upon which said helix is mounted; and means for matching the helix feed end impedance to a desired impedance and including a conductive ground plane member having a surface at least a portion of which is in a plane substantially perpendicular to said axis and fixedly mountable; and an insulative member fixedly attached to said support tube and having a first surface located adjacent to said ground plane member surface to enable said tube and helix to rotate about said axis.

2. The antenna of claim 1, wherein said insulative member has a second surface, opposite to said first surface; and further including an additional insulative member fixedly positioned substantially parallel to the plane of said conductive ground plane member surface and adjacent to said insulative member second surface, to substantially prevent axial movement of said insulative member and said tube when said tube and helix are rotated about said axis.

3. The antenna of claim 1, where said impedance-matching means includes a coaxial impedance transformer.

4. The antenna of claim 3, wherein said transformer has a stationary center conductor; and further including rotary joint means for enabling said helix feed end to rotatably contact said stationary center conductor during rotation of said helix about said axis.

5. The antenna of claim 4, wherein said center conductor has a first end located adjacent to said helix feed end; and said rotary joint means includes an aperture formed in said center conductor first end, said aperture being positioned along said axis and of diameter greater than the diameter of the helix feed end conductor; said helix feed end conductor being positioned within said aperture; a quantity of a conductive liquid; and means for sealing said liquid within said aperture and in contact between said helix feed end and said center conductor first end.

6. The antenna of claim 1, wherein said impedance-matching means includes a conductive cup member having a wall portion diverging toward an end of said helix furthest from said feed end.

7. An antenna array comprising a plurality of the antennas of claim 1 arranged with the axes thereof substantially parallel; said array having a major gain lobe steerable over an angle, in a plane passing through the axes of any pair of said plurality of antennas, by adjustably rotating the helix of at least one of said plurality of antennas.

8. The array of claim 7, wherein said plurality of antennas is mounted upon a base member.

9. The array of claim 8, wherein the impedance-matching means of each of said plurality of antennas includes a conductive cup member recessed into, and fixedly mounted onto, said base member.

10. The array of claim 7, having a plurality $N^2$, where N is an integer, of antennas arranged in a square matrix having N antennas upon each side thereof.

11. The array of claim 7, having a plurality N×M, where N and M are integers, of antennas arranged in a rectangular array.

12. The array of claim 7, further comprising means for combining the signal from each of said plurality of antennas into a single antenna array output signal.

13. The array of claim 12, wherein each of said plurality of antennas is spaced at one of a discrete plurality of distances from an array center line; and further comprising means coupled to the rotatable portion of each antenna for rotating all antennas at a like discrete distance from said center line by a predetermined amount responsive to a single antenna steering stimulus.

14. The array of claim 13, wherein said rotating means comprises gear means at each antenna for rotating the helix thereof responsible to said single stimulus.

15. An antenna comprising:

a conductive helix having a feed end, said helix being rotatable about an axis thereof;

coaxial impedance transformer means, of fixedly mountable structure, for matching the helix feed end impedance to a desired impedance and adapted to allow rotation of said helix about said axis; said coaxial transformer means comprising a stationary center conductor having a first end located adjacent to said helix feed end;

rotary joint means for enabling said helix feed end to rotatably contact said stationary center conductor during rotation of said helix about said axis and including an aperture formed in said center conductor first end, said aperture being positioned along said axis and of diameter greater than the diameter of the helix feed end conductor; said helix feed end conductor being positioned within said aperture;

a quantity of a conductive liquid; and means for sealing said liquid within said aperture and in contact between said helix feed end and said center conductor first end.

16. The antenna of claim 15, wherein said helix feed end is positioned essentially upon said axis.

17. The antenna of claim 16, wherein said helix is mounted on an insulative support tube.

18. The antenna of claim 15, wherein said impedance-matching means includes a conductive cup member having a wall portion diverging toward an end of said helix furthest from said feed end.

19. An antenna array comprising a plurality of the antennas of claim 15 arranged with the axes thereof substantially parallel: said array having a major gain lobe steerable over an angle, in a plane passing through the axes of any pair of said plurality of antennas, by adjustably rotating the helix of at least one of said plurality of antennas.

20. The array of claim 19, wherein said plurality of antennas is mounted upon a base member.

21. The array of claim 20, wherein the impedance-matching means of each of said plurality of antennas includes a conductive cup member recessed into, and fixedly mounted onto, said base member.

22. The array of claim 19, having a plurality $N^2$, where N is an integer, of antennas arranged in a square matrix having N antennas upon each side thereof.

23. The array of claim 19, having a plurality $N \times M$, where N and M are integers, of antennas arranged in a rectangular array.

24. The array of claim 19, further comprising means for combining the signal from each of said plurality of antennas into a single antenna array output signal.

25. The array of claim 24, wherein each of said plurality of antennas is spaced at one of a discrete plurality of distances from an array center line; and further comprising means coupled to the rotatable portion of each antenna for rotating all antennas at a like discrete distance from said center line by a predetermined amount responsive to a single antenna steering stimulus.

26. The array of claim 25, wherein said rotating means comprises gear means at each antenna for rotating the helix thereof responsible to said single stimulus.

27. The antenna of claim 17, wherein said matching means includes a conductive ground plane member having a surface at least a portion of which is in a plane substantially perpendicular to said axis; and further comprising an insulative member fixedly attached to said support tube and having a first surface located adjacent to said ground plane member surface to enable said tube and helix to rotate about said axis.

28. The antenna of claim 27, wherein said insulative member has a second surface, opposite to said first surface; and further including an additional insulative member fixedly positioned substantially parallel to the plane of said conductive ground plane member surface and adjacent to said insulative member second surface, to substantially prevent axial movement of said insulative member and said tube when said tube and helix are rotated about said axis.

* * * * *